US005842105A

United States Patent [19]

Acquaviva

[11] Patent Number: 5,842,105

[45] Date of Patent: Nov. 24, 1998

[54] CONTROLLED MOISTURIZATION OF PAPER TO ELIMINATE CURL

[75] Inventor: Thomas Acquaviva, Penfield, N.Y.

[73] Assignee: Xerox Corporation, Stamford, Conn.

[21] Appl. No.: 940,110

[22] Filed: Sep. 29, 1997

[51] Int. Cl.[6] ..... G03G 15/00

[52] U.S. Cl. ..... 399/406; 399/44

[58] Field of Search ..... 399/44, 69, 94, 399/97, 91, 406, 397; 162/197, 270; 271/161, 188, 209

[56] References Cited

U.S. PATENT DOCUMENTS 5,264,899 11/1993 Mandel ..... 399/341

5,434,029 7/1995 Moser ..... 430/97

*Primary Examiner*—Arthur T. Grimley
*Assistant Examiner*—Hoan Tran
*Attorney, Agent, or Firm*—William A. Henry, II

[57] ABSTRACT

A system which controls image dependent curl by moisturizing a sheet immediately after fusing, determines critical machine and environmental characteristics through a series of on-line sensors. An operator selectable table is used to indicate the type of sheet loaded in each sheet holding tray. Machine software then uses this information to determine how much moisture should be added to each side of the sheet in order to achieve a flat sheet when it reaches equilibrium

8 Claims, 3 Drawing Sheets

CONTROLLED MOISTURIZATION OF PAPER TO ELIMINATE CURL

BACKGROUND OF THE INVENTION

1. Field of the Invention.

This invention relates generally to a substrate conditioning device for an electrophotographic printing machine and, more particularly, concerns a moisture control system that applies moisture to cut sheets in a full color process printing machine such that sheets reach equilibrium in a relatively uncurled or flat state.

2. Description of the Prior Art.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotography, it is desirable to use an architecture which comprises a plurality of image forming stations. One example of the plural image forming station architecture utilizes an image-on-image (IOI) system in which the photoreceptive member is recharged, reimaged and developed for each color separation. This charging, imaging, developing and recharging, reimaging and developing, all followed by transfer to paper, is done in a single revolution of the photoreceptor in so-called single pass machines, while multipass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet and heats the toner above the glass transition temperature. As the toner cools and hardens, it assumes the size of the paper which is now smaller than its final size due to the moisture loss. However, over the next 2 to 30 minutes, the paper absorbs moisture from the environment and expands. The toner does not expand and this creates stresses which results in curl.

A number of solutions to this problem have been advanced. One solution advanced is to use an offset press dampening system to add moisture to each sheet as it exits the copier. These systems typically rely on the generation of a pool of water at a roll interface to distribute the water evenly along the rolls. Such systems usually operate with a web paper supply and their use with a cut sheet feeder system creates some difficulties not previously contemplated or addressed. Normal dampening systems are more appropriate for use with conventional offset presses.

U.S. Pat. No. 4,652,110 (the contents of which are hereby incorporated by reference) attempts to replenish moisture lost in the fixing process by collecting moisture as it is driven off the copy sheet for reapplication to the sheet at a later time.

It is still desirable to control curl by moisturizing the paper immediately after fusing so that in the equilibrated state, the paper will be at or close to the size of the hardened toner.

The following disclosures may be relevant to various aspects of the present invention:

U.S. Pat. No. 5,434,029

Inventor: Moser

Issue Date: Jul. 18, 1995

U.S. Pat. No. 5,264,899

Patentee: Mandel

Issued: Nov. 23, 1993

Portions of the foregoing disclosures may be briefly summarized as follows:

U.S. Pat. No. 5,434,029 describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aftermentioned nip.

U.S. Pat. No. 5,264,899 describes a system for adding moisture to a copy sheet. The toner fixation step of electrostatographic reproduction desiccates paper, which may lead to the formation a wave along the sheet edge. The invention uses a pair of porous rolls defining a nip to transfer additional moisture to the copy sheet as it is passed through the nip. The added moisture prevents edge wave formation.

SUMMARY OF THE INVENTION

In accordance with an aspect of the present invention, there is provided a copier/printer, comprising: a pair of reservoirs with each of said pair of reservoirs storing a quantity of liquid; first and second generally cylindrical transfer rolls, each having an outer cylindrical surface which can be made to retain a thin film of fluid; first and second generally cylindrical back-up rollers, each having an outer cylindrical surface which can be rubber coated and suited to driving paper; said first and second transfer rolls and said first and second back-up rolls being aligned with respect to one another along their axis so as to define a small gap between said outer cylindrical surfaces; first and second metering rolls with each of said metering rolls in circumferential surface contact with one of said first and second cylindrical transfer rolls for metering a thin film of fluid to said outer surface of said first and second cylindrical transfer rolls; a paper path spanning the distance between said first transfer and back-up rolls and said second transfer and back-up rolls, said paper path supports and guides the sheet between said rolls; a pair of servo motors with one each of said servo motors being connected to one each of said transfer roller metering roller pair for driving said rolls; an additional servo motor being connected to both back-up rolls for driving said rolls; and a controller connected to said transfer roll servo motors for controlling said transfer roll servo motors in driving said transfer roll servo motors in the opposite direction to the paper path direction thereby controlling the amount of fluid applied to each side of said sheet.

BRIEF DESCRIPTION OF THE DRAWINGS

Other features of the present invention will become apparent as the following description proceeds and upon reference to the drawings, in which.

DETAILED DESCRIPTION OF THE INVENTION

This invention relates to an imaging system which is used to produce color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Figure 1:
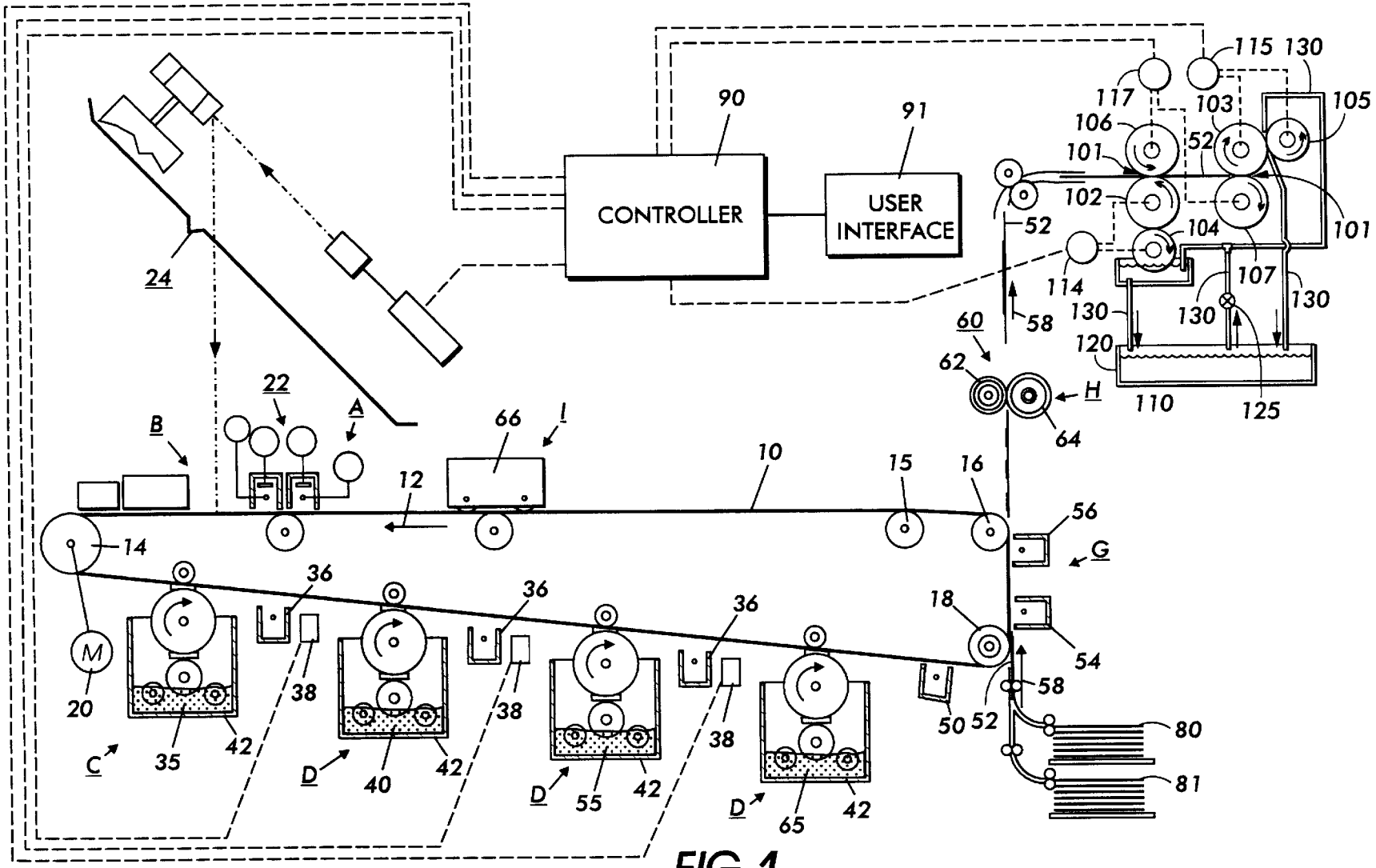
FIG. 1 is a schematic elevational view of a full color image-on-image single pass electrophotographic printing machine utilizing the device described herein.

Turning now to FIG. 1, the printing machine 8 of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, tension roller 16 and fixed roller 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station B. At imaging/exposure station B, a controller, indicated generally by reference numeral 90, receives the image signals representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station C with black toner 35, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second exposure/imaging device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HJD developer system. A power supply (not shown) serves to electrically bias the developer structure to a level effective to develop the discharged image areas with negatively charged yellow toner particles 40.

The above procedure is repeated for a third imager for a third suitable color toner such as magenta and for a fourth imager and suitable color toner such as cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved either tray 80 or 81 into contact with the toner images at transfer station G. The sheet of support material is advanced to transfer station G by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
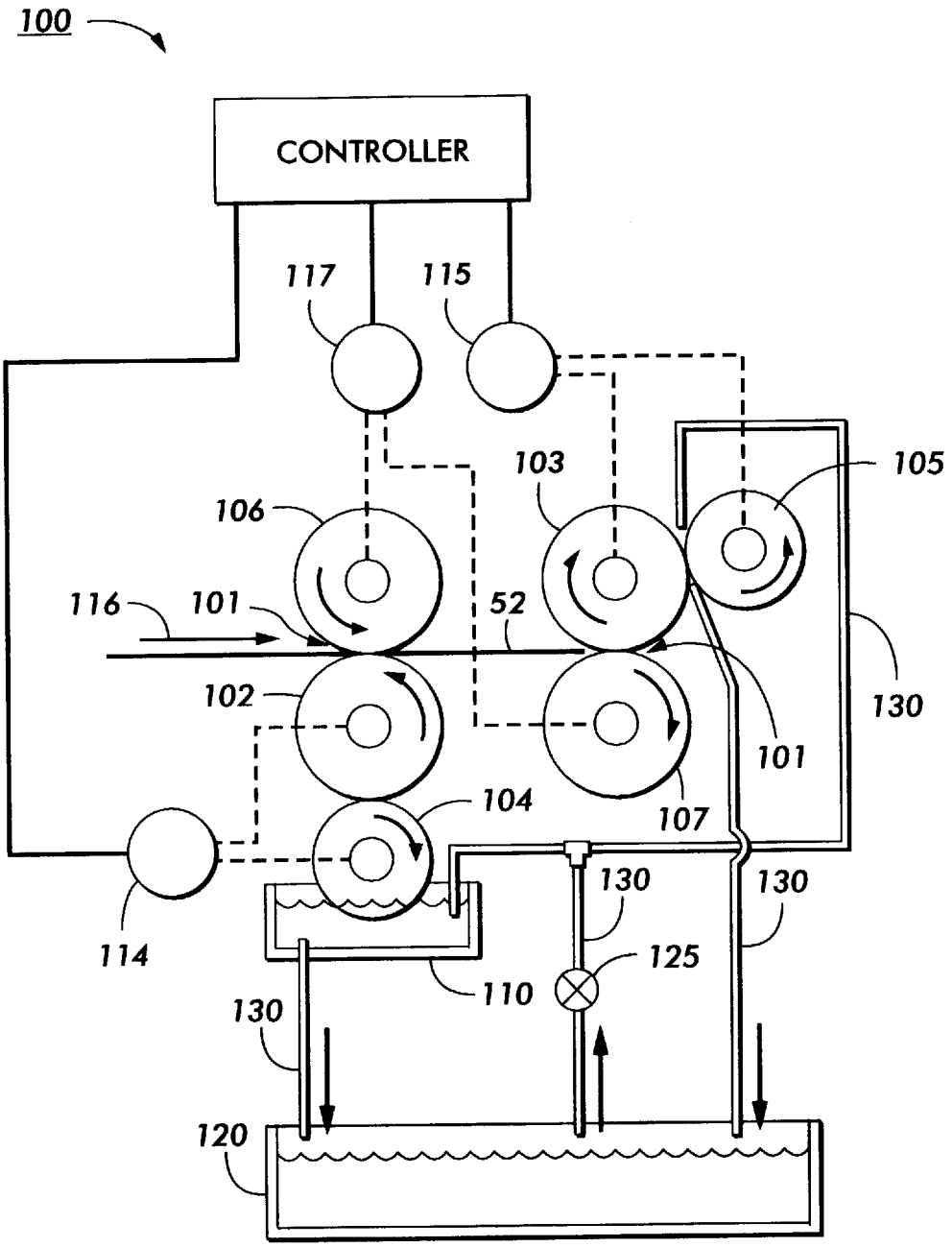
FIG. 2 is a detailed elevational side view of the paper conditioning device in accordance with the present invention.

As shown in FIG. 2, the sheet conditioning device, generally referred to as reference numeral 100, has transfer rollers 102 and 103 which are contacted by the lead edge of incoming sheets 52 as the sheets enter the nip area 101. Transfer rollers 102 and 103 are fixed as are metering rollers 104 and 105 that are in nip forming contact with transfer rollers 102 and 103, respectively. Back-up rollers 106 and 107 form a nip with transfer rollers 102 and 103, respectively, while paper is present. Metering roller 104 is positioned with a portion thereof situated within an open part of fluid pan 110. Metering roller 105 is positioned in contact with transfer roller 103 to form a fluid reservoir in the nip 111. End seals (not shown) retain the fluid in said reservoir. Servo motors 114 and 115 are connected to transfer and metering rollers 104 and 102, and 103 and 105 respectively, and are adapted to drive the transfer rolls in the opposite direction to the paper travel through the paper path 116 and thereby controlling the amount of fluid applied to each surface. Servo motor 117 is connected and adapted to drive the back-up rollers 106, and 107 in the same direction to the paper travel through the paper path 116. The wetting agent, in this case water, is distributed to the metering rolls 104 and 105 from a pan and reservoir 110, 120, respectively, by way of reservoir 120, pump 125, and hoses 130. It should be understood that transfer rollers 102 and 103, as well as, metering rollers 104 and 105 could be made to articulate up and down to open and close nips with the back-up rollers 106 and 107, if desired.

There are many parameters which contribute to curl, some of which are fixed by the machine fuser configuration, xerographics, or are outside the control of the machine, such as, image location and image density. Some variables which affect how much moisture needs to be added for a sheet to rapidly reach equilibrium in an uncurled condition after fusing are: fuser and pressure roll temperature (affects moisture loss in the fuser); dwell time; initial sheet moisture content while in the feeder tray (will determine post fuser sheet moisture content); pre-fuser sheet temperature (will determine temperature rise and, therefore, moisture loss in the fuser); room relative humidity and temperature (determines equilibration relative humidity); wire or felt side being imaged (determines moisturization rate); sheet characteristics, such as, sheet basis weight, density, thickness, percent of moisture change as a function of fuser temperature, initial percent moisture, etc. (determines amount of moisture loss in the fuser).

Figure 3:
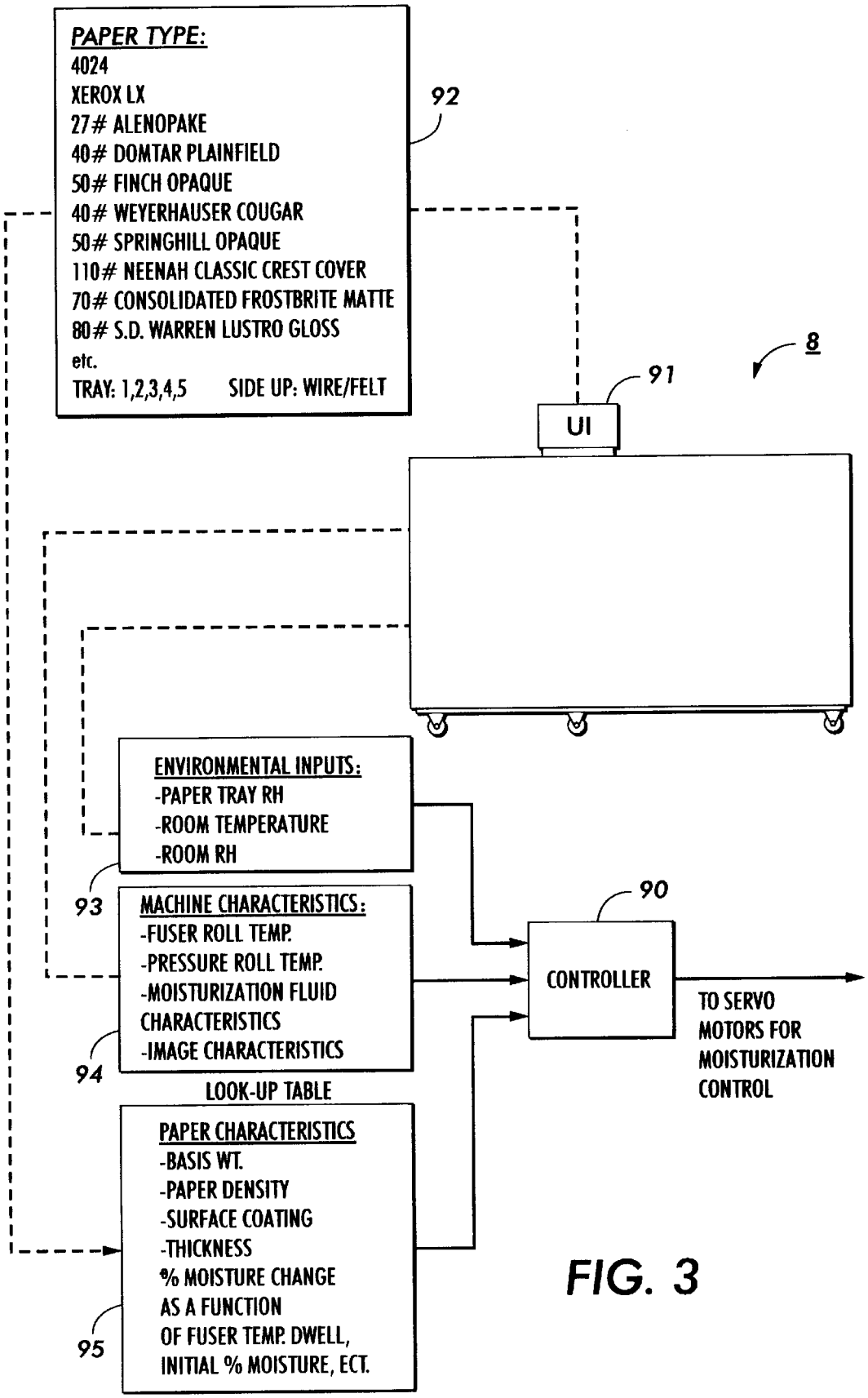
FIG. 3 is a block diagram of moisturization inputs/outputs for curl control in accordance with the present invention.

Machine 8 in FIG. 3, in accordance with the present invention, is equipped with conventional temperature and humidity sensors to monitor machine characteristics as shown in block 94, environmental conditions as depicted in block 93, and a look-up table at block 95 that includes various paper characteristics. A user interface (UI) 91 allows an operator to inform the machine of the type of paper used as shown in block 92 which in turn sends a signal for incorporation into look-up table 95. Output signals from all three sources (93, 94 and 95) go to a controller 90 which uses appropriate conventional algorithms to adjust the amount of moisture added to each side of a sheet as it exits the fuser.

In use, an operator will designate which sheet is loaded in which supply tray via a selection on UI 91. The operator then indicates on the UI whether the sheets are loaded wire side or felt side up. This information is used in look-up table 95 which contains information about now the moisture content of that particular sheet changes as a function of fuser temperature, initial sheet temperature, initial moisture content, moisturization fluid characteristics, etc. This information could be determined experimentally. Given all these variables, controller 90 determines and adjusts the amount of water being transferred to each side of the sheet 52 by actuating servo motors 114 and 115 that are connected to transfer rolls 102 and 103 accordingly to either increase or decrease the speed of the transfer rollers in the opposite direction to the back-up rollers. This ultimately meters the proper amount of water to each side of the sheet as it exits the fuser. The toner then solidifies onto the sheet, and the sheet soon reaches its equilibrates size. The moisturization process can leave the sheet with a slightly higher than equilibrated moisture content as it leaves the machine. Additional contraction of the toner as it cools to room temperature will be compensated for by some contraction of the sheet as the excess moisture is lost to the environment.

An algorithm for controlling the speed of the stepper motors which determine the amount of water applied to each side of the sheet:

Transfer roll speed=V0 (a1+a2+a3+a4+a5+a6 . . . )

Where V0 is a nominal speed equal to and in the opposite direction as the back-up roll speed, and a1 is a coefficient associated with paper stiffness, a2 is a coefficient associated with basis weight, a3 is associated with fuser temperature, a4 is associated with wire or felt side, a5 is associated with surface coating, a6 is associated with image density, etc.

For example, if the fuser roller or pressure roller temperature is high, more moisture needs to be added since more would be driven out in the fuser. If the paper stiffness is high, its beam strength will resist curling and less moisture needs to be added. If the image density is high, the imaged sheet will require more moisture to resist the effect of the increased toner mass.

In recapitulation, there is provided a scheme for determining the critical machine and environmental characteristics through a series of on-line sensors, and to use an operator selectable table to indicate the type of paper loaded in each paper tray. Software then uses this information to determine how much moisture should be added to each side of a sheet of paper in order for it to reach a flat state when it reaches equilibrium moisture content. For example, different amounts of moisture can be added to each and every sheet in a precollated print job by using the heretofore mentioned algorithm. The transfer roll speed would change between sheets entering the nip formed between the transfer roll and back-up roll. Hardware is included that upon actuation by the software places the desired predetermined film thickness on each sheet surface.

It is, therefore, apparent that there has been provided in accordance with the present invention, a paper conditioning device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A system that add moisture to copy sheets while en route in a copier/printer to curl, comprising:

a pair of back-up rolls and a pair of cylindrical transfer rolls, each having an outer cylindrical surface, said transfer rolls and said back-up rolls defining a nip between said outer cylindrical surfaces;

a pair of metering rolls with one each of said pair of metering rolls in circumferential surface contact with one each of said cylindrical transfer rolls for wetting said outer surface of said pair of cylindrical transfer rolls;

a pair of servo motors with one each of said servo motors being connected to one each of said transfer rolls; and a controller connected to said servo motors for controlling said servo motors in driving said pair of transfer rolls in a direction opposite to the direction of conveyance of the sheets at the nip area and thereby controlling the amount of fluid applied to each side of the sheets.

2. A system for controlled moisturization of copy sheets while en route in a copier/printer to eliminate curl, comprising:

a pair of reservoirs with each of said pair of reservoirs storing a quantity of liquid;

a pair of back-up rolls, each having an outer cylindrical surface;

a pair of generally cylindrical transfer rolls, each having an outer cylindrical surface, said transfer rolls and said back-up rolls being aligned with respect to one another along their axes so as to define a nip between said outer cylindrical surfaces;

a pair of metering rolls with one each of said pair of metering rolls in circumferential surface contact with one of said cylindrical transfer rolls for wetting said outer surface of said pair of cylindrical transfer rolls;

a pair of servo motors with one each of said servo motors being connected to one each of said transfer rolls; and a controller connected to said servo motors for controlling said servo motors in driving said transfer rolls in a direction opposite to the direction of conveyance of the sheets and thereby controlling the amount of fluid applied to each side of the sheets at the nip area.

3. A system for fixing a toner image to a copy sheet in an electrophotographic system so as to avoid the formation of a curl in the body of the sheet, comprising:

first and second fusing rollers defining a nip therebetween, at least one of said fusing rollers being heated, wherein the fusing rollers serve to fix a toner image on a copy sheet through the application of heat and pressure to the copy sheet;

a sheet conditioning system for receiving a copy sheet from said fusing rollers, comprising;

a pair of reservoirs with each of said pair of reservoirs storing a quantity of liquid;

a pair of back-up rolls with each having an outer cylindrical outer surface;

a pair of cylindrical transfer rolls, each having an outer cylindrical surface, said transfer rolls and said back-up rolls being aligned with respect to one another along their axes so as to define a nip when a sheet is present between said outer cylindrical surfaces;

a pair of metering rolls with one each of said pair of metering rolls in circumferential surface contact with one of said cylindrical transfer rolls for wetting said outer surface of said pair of cylindrical transfer rolls;

a pair of servo motors with one each of said servo motors being connected to one each of said transfer rolls for driving said transfer rolls; and a controller connected to said servo motors for controlling said servo motors in driving said transfer rolls in a direction opposite to movement of the sheet at the nip area.

4. The system according to claim 3, including a tray for holding the copy sheets, and sensors for sensing relative humidity of said tray, room temperature and room relative humidity and transmitting signals indicative of the same to said controller.

5. A system according to claim 4, including inputs to said controller characterizing fuser roll temperature, dwell time, pressure roll temperature and moisturization fluid characteristics.

6. The system according to claim 5, including a lookup table that provides input to said controller of sheet characteristics encompassing sheet basis weight, sheet density, surface coating, thickness and percent of moisture change as a function of fuser temperature, and initial percent of moisture.

7. The system according to claim 6, wherein said controller either increases or decreases servo motor speed based on environmental inputs, machine characteristics, paper characteristics, and image type.

8. A method for replenishing the moisture that a copy sheet loses as it is heated in an electrophotographic machine of the type having a thermal fuser having a fuser roll and pressure roll, comprising the steps of:

transporting liquid from a one each of a pair of reservoirs to one each of a pair of transfer rolls that are arranged so as to form nips with a pair of back-up rolls when a copy sheet is present;

transporting the copy sheet from the fuser through the nip of the rolls;

transferring liquid from the transfer rolls to one or both sides of the copy sheet; and controlling the amount of liquid placed on said pair of transfer rolls in accordance with parameters including fuser roll temperature, pressure roll temperature, ambient relative humidity, percent of surfactant in the liquid, temperature of the liquid, side of the sheet imaged, and sheet characteristics including basis weight, sheet density, thickness, and sheet surface characteristics.

* * * * *